US008680914B2

(12) United States Patent
Singnurkar

(10) Patent No.: US 8,680,914 B2
(45) Date of Patent: Mar. 25, 2014

(54) CONTROLLED CURRENT SOURCE AND METHOD FOR SOURCING A CURRENT

(75) Inventor: Pramod Singnurkar, Graz (AT)

(73) Assignee: AMS AG, Unterpremstaetten (AT)

( * ) Notice: Subject to any disclaimer, the term of this patent is extended or adjusted under 35 U.S.C. 154(b) by 285 days.

(21) Appl. No.: 12/993,754

(22) PCT Filed: May 18, 2009

(86) PCT No.: PCT/EP2009/056016

§ 371 (c)(1),
(2), (4) Date: Feb. 7, 2011

(87) PCT Pub. No.: WO2009/141314

PCT Pub. Date: Nov. 26, 2009

(65) Prior Publication Data

US 2011/0187338 A1 Aug. 4, 2011

(30) Foreign Application Priority Data

May 21, 2008 (EP) ..... 08009393

(51) Int. Cl.
*G06F 1/10* (2006.01)

(52) U.S. Cl.
USPC ..... 327/538; 327/543

(58) Field of Classification Search
USPC ..... 323/315, 311–314; 327/538–544, 546, 327/530
See application file for complete search history.

(56) References Cited

U.S. PATENT DOCUMENTS 4,967,140 A * 10/1990 Groeneveld et al. ..... 323/315
5,844,404 A * 12/1998 Caser et al. ..... 323/314
6,480,127 B1 11/2002 Aslan
6,778,429 B1 8/2004 Lu et al.
2002/0093374 A1 * 7/2002 Bedarida et al. ..... 327/538
2004/0246026 A1 12/2004 Wang et al.
2005/0057457 A1 * 3/2005 Date ..... 345/76
2005/0093616 A1 * 5/2005 Chen ..... 327/538
2006/0002172 A1 * 1/2006 Venkataraman et al. ..... 365/148
2006/0255787 A1 * 11/2006 Schaffer et al. ..... 323/315
2007/0222720 A1 * 9/2007 Kim ..... 345/82
2010/0195414 A1 * 8/2010 Kim et al. ..... 365/189.07

OTHER PUBLICATIONS

"AS3685A/AS3685B—Ultra Small High Efficiency 700 mA Charge Pump for White LED Flash", Product Brief, www.autriamicrosystems.com, Revision 2.0/20060726, pp. 1-2.

* cited by examiner

*Primary Examiner* — Gary L Laxton
*Assistant Examiner* — Kyle J Moody
(74) *Attorney, Agent, or Firm* — McDermott Will & Emery LLP

(57) ABSTRACT

A controlled current source comprises a signal input to receive a control input bus signal (D0, . . . , D[n−1]), a mapping unit (MU) with an input coupled to the signal input and an output to provide an internal control bus signal (d0, . . . , dn, Hc), a reference generator (RG) with an input coupled to the output of the mapping unit (MU) and with a low reference output to provide a low reference potential (Vgl) and with a high reference output to provide a high reference potential (Vgh), a current generating unit (CG) with a first input coupled to the output of the mapping unit (MU), a second input coupled to the output of the reference generator (RG) and an output to provide an output current (Iout) controlled by the control input bus signal (D0, . . . , D[n−1]) and the low and high reference potentials (Vgh, Vgl). Furthermore, a method for sourcing a current is provided.

9 Claims, 6 Drawing Sheets

CONTROLLED CURRENT SOURCE AND METHOD FOR SOURCING A CURRENT

RELATED APPLICATIONS

This is a U.S. national stage of application No. PCT/EP2009/056016 filed on May 18, 2009. This application claims the priority of European application no. 08009393.3 filed May 21, 2008, the entire content of which is hereby incorporated by reference.

FIELD OF THE INVENTION

The invention relates to a controlled source and to a method for sourcing a current.

BACKGROUND OF THE INVENTION

In the field of current sources or current sinks an output current can be generated which is controllable by a certain number of bits to tune the exact value of the output current. One existing implementation of such a digitally controlled current source comprises a transistor arrangement for sourcing the output current and a regulation circuit. The transistor arrangement and the regulation circuit are coupled to each other via a set of switches which are directed by a control signal comprising a number of bits. The number of bits determines the number of levels of the digitally controlled source. The number of transistors of the transistor arrangement corresponds to the number of bits. The sizes of the transistors are selected in a way that they increase with $2^n$, with n ranging from zero to the total number of bits. The regulation circuit generates a constant reference current which is used by the transistor arrangement to source the output current depending on the control signal.

In some applications, a controlled current source with less power consumption can be necessary.

SUMMARY OF THE INVENTION

It is an objective of the invention to provide an improved controlled current source and an improved method for sourcing a current with less power consumption and less area.

In one exemplary embodiment, a controlled current source comprises a signal input to receive a control input bus signal, a mapping unit, a reference generator and a current generating unit. The mapping unit has an input coupled to the signal input and an output to provide an internal control bus signal. The reference generator has an input coupled to the output of the mapping unit, a low reference output to provide a low reference potential and a high reference output to provide a high reference potential. The current generating unit has a first input coupled to the output of the mapping unit, a second input coupled to the output of the reference generator and an output to provide an output current. The output current is controlled by the control input bus signal and the low and high reference potentials.

The control input bus signal is applied to the mapping unit. The mapping unit provides the internal control bus signal as a function of the control input bus signal. The reference generator generates the low and the high reference potentials. The current generating unit provides the output current as a function of the control input bus signal using the high and low reference potentials. The provisioning of the internal control bus signal is achieved by coding or decoding the control input bus signal.

The structure of the reference generator acting as a regulation circuit results in two reference potentials: The low reference potential which is used for a first subset of current levels provided by the controlled current source and the high reference potential which is used in addition to the low reference potential for a second subset of current levels provided by the controlled current source. This leads to an improved control strategy with a reduced current consumption and reduced size.

In another exemplary embodiment, the control input bus signal comprises a binary coded digital signal with n bits.

In a further exemplary embodiment, the internal control bus signal comprises a binary coded digital signal with (n+1) bits.

Using the n bit control input bus signal and mapping it into the n+1 bit internal control bus signal, the $2^n$ step or level linear controlled current source can be designed. For the first subset of current levels ranging from zero to $2^{n-1}-1$, only the low reference potential is needed. For the second subset of current levels ranging from $2^{n-1}$ to $2^n$, the low and the high reference potentials are required to provide the output current.

In one embodiment, the reference generator comprises a second input to receive a first reference current, a second reference current and a defining potential.

By use of the first and second reference currents and the defining potential, the reference generator provides the high and the low reference potentials.

As the high reference potential is only generated for the second half of current levels of the controlled current source, a significant reduction in power consumption is achieved.

In another exemplary embodiment, the current generating unit comprises a coupling unit and a current sourcing array. The coupling unit comprises the first input of the current generating unit to receive the internal control bus signal, the second input of the current generating unit to receive the low and the high reference potentials and it comprises an output to provide a gate signal bus. The current sourcing array comprises an input coupled to the output of the coupling unit and the output which provides the output current.

The gate signal bus is generated as a function of the internal control bus signal using the low and/or high reference potentials. Applied to the current sourcing array the gate signal bus drives the level of the output current.

In another exemplary embodiment the current sourcing array comprises an array of transistors coupled in parallel, with their gate terminals coupled to the output of the coupling unit. At the same time, sizes s of the transistors of the array of transistors defined as a quotient of channel width and length are selected as a product of 0.5 and $2^x$, with x ranging from 0 to n−1, and a size of the last transistor matching the respective size of the second-last transistor. The transistors can be implemented as metal oxide semiconductor, MOS, transistors.

The transistors of the current sourcing array are operated as current sources with the ability to provide a current with a value depending on the size s of the respective transistor. The gate signal bus controls the respective transistor or transistors.

As the sizes s of the last and the second-last transistors match one another, a reduction in layout is achieved compared to existing implementations where the size of the last transistor is twice the size of the second-last transistor.

In another exemplary embodiment, the reference generator comprises a first and a second equalizer, as well as a first and a second differential amplifier. The first equalizer provides a first threshold potential corresponding to the defining potential. The second equalizer provides a second threshold potential corresponding to the defining potential. The first amplifier provides the low reference potential using the first reference current and a first feedback current at the first threshold potential. The second amplifier provides the high reference potential using the second reference current and a second feedback current at the second threshold potential.

The reference generator maintains the low and the high reference potentials at a constant value respectively.

In another exemplary embodiment the control input bus signal comprises an additional control component and the internal control bus signal comprises an additional internal component.

The additional control component and the additional internal component enable the controlled current source to provide a higher range of current levels using the same number of transistors in the current sourcing array. The range of the current source is extended to $2^n+2^{n-1}-1$ current levels.

In another exemplary embodiment the internal control bus signal comprises a second additional internal component.

Using the second additional internal component, the resolution of the controlled current source is enhanced.

In one exemplary embodiment of a method for sourcing a current, a control input bus signal is supplied. Furthermore, a first and a second reference current as well as a defining potential are supplied. An internal control bus signal is provided as a function of the control input bus signal. The internal control bus signal is forwarded to a current generating unit. An output current is generated for a first subset of current levels as a function of the control input bus signal, and a low reference potential, and for a second subset of current levels as a function of the control input bus signal, the low and a high reference potential.

As the generation and the regulation of a reference potential is split up into two parts, namely the low and the high reference potentials, less power is consumed.

DETAILED DESCRIPTION OF THE DRAWINGS

Figure 1:
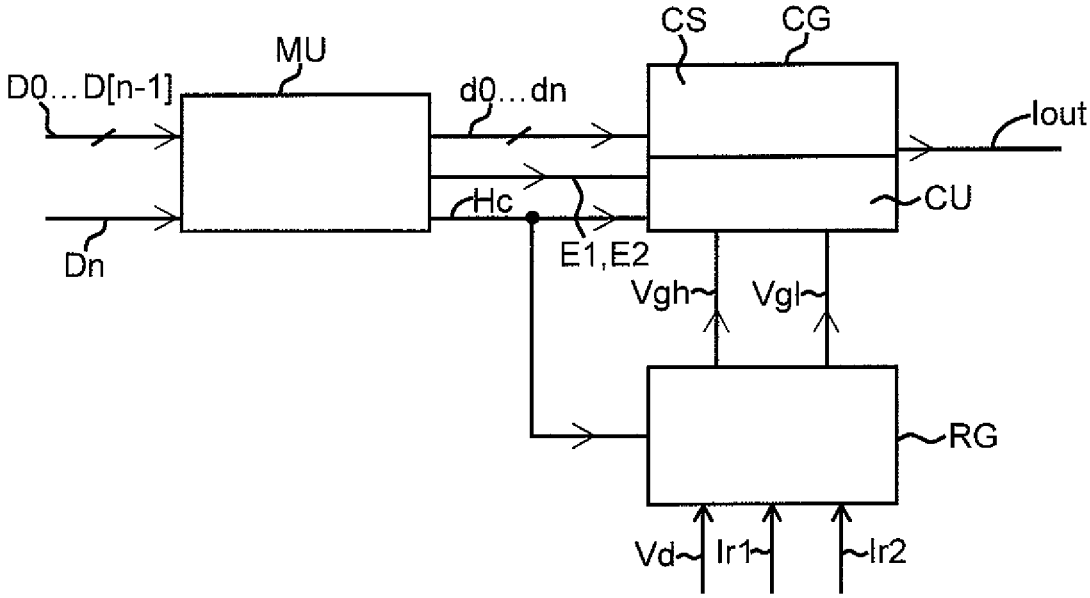
FIG. 1 shows a first exemplary embodiment of a controlled current source.

FIG. 1 shows a first exemplary embodiment of a controlled current source. The controlled current source comprises a mapping unit MU, a current generating unit CG and a reference generator RG. The mapping MU comprises a signal input to receive a control input bus signal D0 to D(n−1) and a signal output to provide an internal control bus signal d0 to dn and a high control signal Hc. The control input bus signal D0 to D(n−1) comprises a binary coded digital signal with n bits. The internal control bus signal d0 to dn comprises a binary coded digital signal with (n+1) bits. The reference generator RG comprises a first input which is coupled to the output of the mapping unit, and a second input to receive a defining potential Vd, a first reference current Ir1 and a second reference current Ir2. The reference generator RG further comprises a reference output to provide a low reference potential Vgl and a high reference output to provide a high reference potential Vgh. The current generating unit CG comprises a coupling unit CU and a current sourcing array CS. The current generating unit CG receives the internal control bus signal d0 to dn provided at the output of mapping unit MU, and it also receives the low and the high reference potentials Vgl, Vgh. The current generating unit CG further comprises an output to provide an output current Iout.

Within the mapping unit MU the n bits of the control input bus signal D0 to D(n−1) are coded into n+1 bits of the internal control bus signal d0 to dn and the high control signal Hc. The internal control bus signal d0 to dn and the high control signal Hc are forwarded to the current generating unit CG. The high control signal Hc is forwarded to the reference generator RG, as well. The reference generator RG generates the low and the high reference potentials Vgl and Vgh using the defining potential Vd, the first and the second reference currents Ir1 and Ir2. Within the current generating unit CG the output current Iout is generated as a function of the control input bus signal D0 to D(n−1) and the low and the high reference potentials Vgl and Vgh. The output current Iout is provided as a multiple of a step current.

To summarize, a $2^n$ step or level digitally controlled current source is realized. For a lower half of codes of the control input bus signal D0 to D(n−1) ranging from zero to $2^{n-1}-1$, only the low reference potential Vgl is necessary. Therefore, for this range of codes a significant reduction in power consumption is achieved.

The mapping or the coding of the control input bus signal D0 to D(n−1) to the internal control bus signal d0 to dn can be realized as follows:

Control input bus signal bit D(n−1) is mapped to the high control signal Hc. If the high control signal Hc equals 0, then the internal control bus signal bits dn and d0 equal 0, respectively. The internal control bus signal bit d(n−1) equals bit D(n−2) of the control input bus signal, internal control bus signal bit d(n−2) equals control input bus signal bit D(n−3), internal control bus signal bit d(n−3) equals control input bus signal bit D(n−4) and so forth until internal control bus signal bit d1 equals control input bus signal bit D0.

If the high control signal Hc equals 1, then internal control bus signal bits dn and d(n−1) equal control input bus signal bit D(n−1), internal control bus signal bit d(n−2) equals control input bus signal bit D(n−2), internal control bus signal bit d(n−3) equals control input bus signal bit D(n−3), internal control bus signal bit d(n−4) equals control input bus signal bit D(n−4) and so forth until internal control bus signal bit d0 equals control input bus signal bit D0.

In an extension of this embodiment of the controlled current source, the current source is extended to provide $2^n+2^{n-1}$ steps or current levels. For this, a respective additional component Dn of the control input bus signal D0 to D(n−1) is supplied to the mapping unit MU. A first additional internal component El is generated by the mapping unit MU. The coding can be realized as follows: The first internal component El equals the respective additional component Dn. The high control signal Hc, and internal control bus signal bits dn and d(n−1) equal 1 respectively. Internal control bus signal bit d(n−2) equals control input bus signal bit D(n−2), internal control bus signal bit d(n−3) equals control input bus signal bit D(n−3), internal control bus signal bit d(n−4) equals control input bus signal bit D(n−4) and so forth until internal control bus signal bit d0 equals control input bus signal bit D0.

With this extension the same controlled current source can provide a higher range of the output current Iout.

By using a second additional internal component E2 the above controlled current source can be further extended. The mapping is changed and can be realized as follows:

The second additional internal component E2 equals 1, the first additional internal component E1 equals 0, the high control signal Hc equals 0, internal control bus signal bit dn equals 0, internal control bus signal bits dn and d(n−1) equal control input bus signal bit D(n−1), internal control bus signal bit d(n−2) equals control input bus signal bit D(n−2), internal control bus signal bit d(n−3) equals control input bus signal bit D(n−3), and so forth until internal control bus signal bit d0 equals control input bus signal bit D0.

With this extension, a refined resolution at half of the step current is achieved for the controlled current source.

Figure 2A:
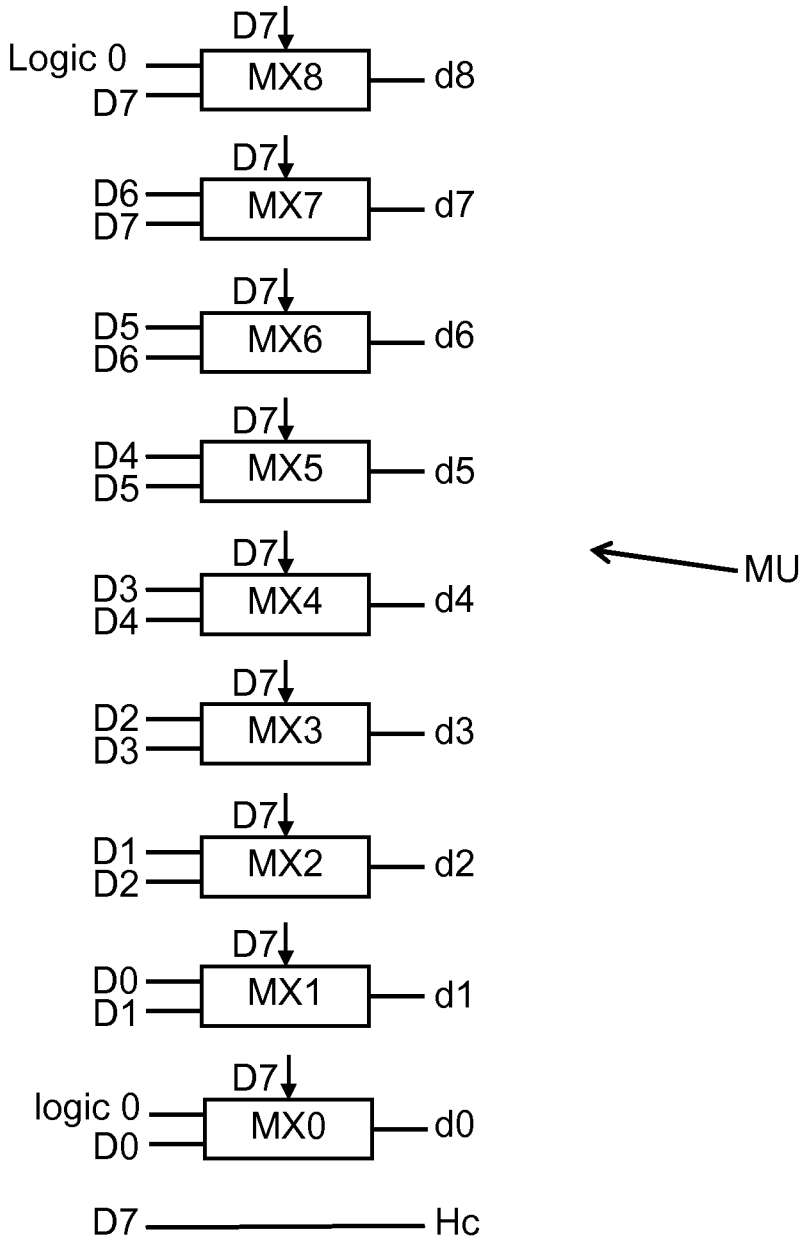
FIG. 2A shows an exemplary embodiment of a mapping unit of a second exemplary embodiment of a controlled current source.

FIG. 2A shows an exemplary embodiment of a mapping unit of a second exemplary embodiment of a controlled current source. The mapping unit MU comprises nine 2:1 multiplexers MX0, MX1, MX2, MX3, MX4, MX5, MX6, MX7, and MX8. Each of the multiplexers MX0 to MX8 comprises two data inputs, one data output and one control input. Bit D7 of the control input bus signal D0 to D7 is applied to every control input of the multiplexers MX0 to MX8. For the multiplexers MX1 to MX7, two consecutive bits of the control input bus signal D0 to D7 are supplied to the respective data inputs, and one bit of the internal control bus signal d0 to d8 is provided at the respective data output. In detail, the higher bit of the control input bus signal Do to D7 is supplied to the lower data input and the lower bit of the control input bus signal D0 to D7 is supplied to the upper data input of each multiplexer. As an example, bit D0 of the control input bus signal D0 to D7 is supplied to the upper data input and the bit D1 of the control input bus signal D0 to D7 is supplied to the lower data input of the multiplexer MX1. Bit d1 of the internal control bus signal d0 to d8 is provided at the data output of the multiplexer MX1. For bit D7 of the control input bus signal D0 to D7 being at logical 0, the upper data input of each multiplexer MX0 to MX8 is forwarded to the respective data output. For bit D7 of the control input bus signal being at logic 1, the lower data input of each multiplexer MX0 to MX1 is forwarded to its respective data output. In the multiplexer MX0, bit D0 of the control input bus signal D0 to D7 is multiplexed with logic 0. For the multiplexer MX8, bit D7 of the control input bus signal D0 to D7 is multiplexed with logic 0.

With the mapping unit MU depicted in FIG. 2A a mapping of codes is realized as demonstrated in Table 1.

TABLE 1

| mapping of codes | | | | | | | | | | | | | | | | | | | |
|---|---|---|---|---|---|---|---|---|---|---|---|---|---|---|---|---|---|---|---|
| Code | D7 | D6 | D5 | D4 | D3 | D2 | D1 | D0 | d8 | d7 | d6 | d5 | d4 | d3 | d2 | d1 | d0 | Hc | Iout |
| 0 | 0 | 0 | 0 | 0 | 0 | 0 | 0 | 0 | 0 | 0 | 0 | 0 | 0 | 0 | 0 | 0 | all 0 | 0 | 0 |
| 1 | 0 | 0 | 0 | 0 | 0 | 0 | 0 | 1 | 0 | 0 | 0 | 0 | 0 | 0 | 0 | 1 | | 0 | 1 × Ilsb |
| 2 | 0 | 0 | 0 | 0 | 0 | 0 | 1 | 0 | 0 | 0 | 0 | 0 | 0 | 0 | 1 | 0 | | 0 | 2 × Ilsb |
| 3 to 125 | | | Linear increments | | | | | | all 0 | | | Linear increments | | | | | | all 0 | Code × Ilsb |
| 126 | 0 | 1 | 1 | 1 | 1 | 1 | 1 | 0 | 0 | 1 | 1 | 1 | 1 | 1 | 1 | 0 | | 0 | 126 × Ilsb |
| 127 | 0 | 1 | 1 | 1 | 1 | 1 | 1 | 1 | 0 | 1 | 1 | 1 | 1 | 1 | 1 | 1 | | 0 | 127 × Ilsb |
| 128 | 1 | 0 | 0 | 0 | 0 | 0 | 0 | 0 | 1 | 1 | 0 | 0 | 0 | 0 | 0 | 0 | 0 | 1 | 128 × Ilsb |
| 129 | 1 | 0 | 0 | 0 | 0 | 0 | 0 | 1 | 1 | 1 | 0 | 0 | 0 | 0 | 0 | 0 | 1 | 1 | 129 × Ilsb |
| 130 | 1 | 0 | 0 | 0 | 0 | 0 | 1 | 0 | 1 | 1 | 0 | 0 | 0 | 0 | 0 | 1 | 0 | 1 | 130 × Ilsb |
| 131 to 253 | | | Linear increments | | | | | | all 1 | all 1 | | | Linear increments | | | | | all 1 | Code × Ilsb |
| 254 | 1 | 1 | 1 | 1 | 1 | 1 | 1 | 0 | 1 | 1 | 1 | 1 | 1 | 1 | 1 | 1 | 0 | 1 | 254 × Ilsb |
| 255 | 1 | 1 | 1 | 1 | 1 | 1 | 1 | 1 | 1 | 1 | 1 | 1 | 1 | 1 | 1 | 1 | 1 | 1 | 255 × Ilsb |

Table 1 shows on the left side all possible codes of the control input bus signal D0 to D7. The second half of Table 1 shows the corresponding codes of the internal control bus signal d0 to d8. In the adjacent column the coding of the high control signal Hc is shown. In the right-most column of Table 1 the corresponding values of the output current Iout are depicted in units of the step current Ilsb. The value of the high control signal Hc corresponds to the value of bit D7 of the control input bus signal D0 to D7.

Figure 2B:
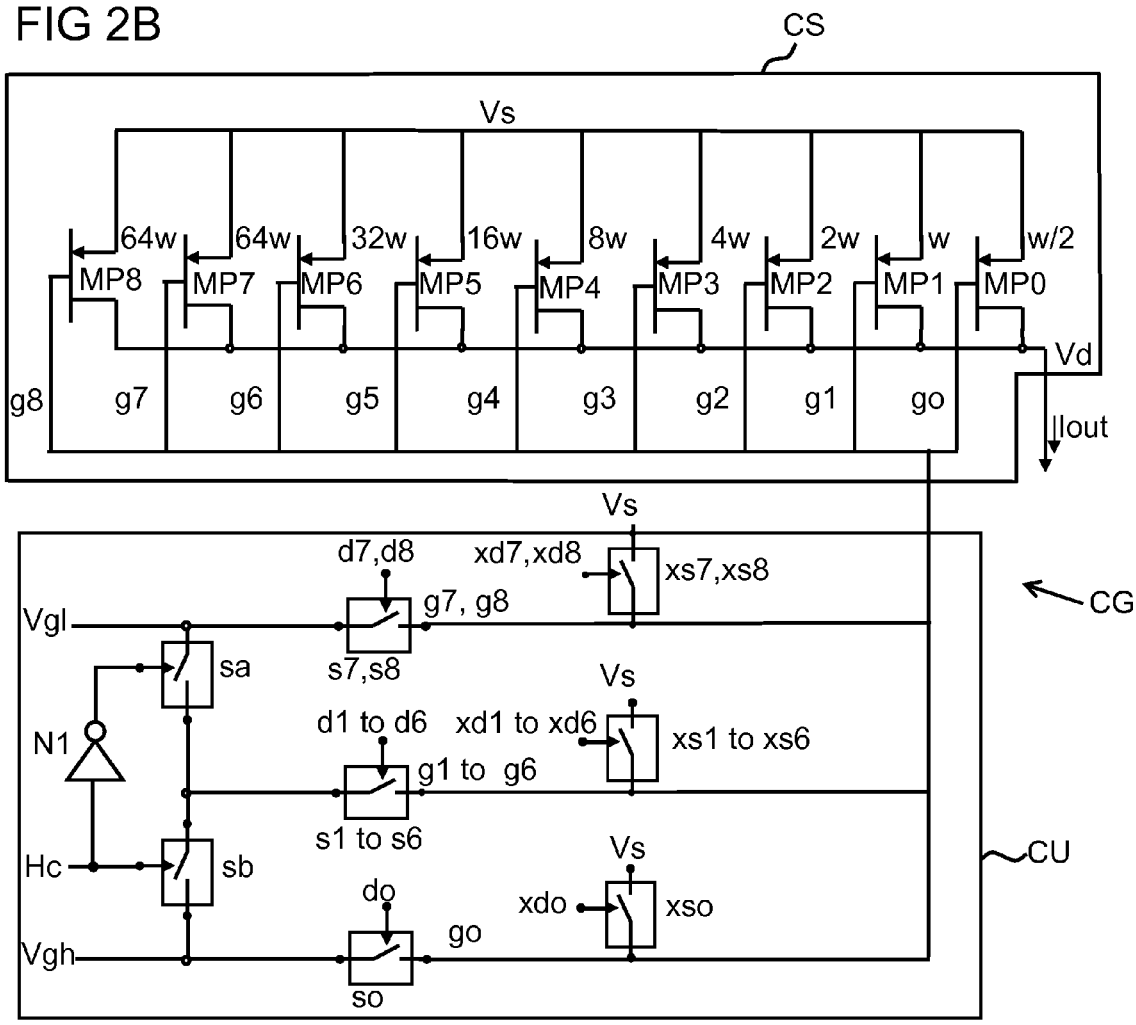
FIG. 2B shows an exemplary embodiment of a current generating unit of the second exemplary embodiment of a controlled current source.

FIG. 2B shows an exemplary embodiment of a current generation unit of the second exemplary embodiment of a controlled current source. For n equal to 8, the current generation unit CG can be coupled to the mapping unit MU of FIG. 2A. Said current generation unit CG comprises a coupling unit CU and a current sourcing array CS. The current sourcing array CS comprises an array of nine transistors MP0, MP1, MP2, MP3, MP4, MP5, MP6, MP7, and MP8. The transistors MP0 to MP8 are coupled in parallel with their respective source terminals coupled to a source potential Vs and their respective drain terminals coupled to a defining potential Vd. Gate terminals of the transistors of the array of transistors MP0 to MP8 are coupled to a gate signal bus g0, g1, g2, g3, g4, g5, g6, g7, and g8. As can be seen, gate signal bus component g0 is coupled to the gate of transistor MP0, gate signal bus component g1 is coupled to the gate of transistor MP1, gate signal bus component g2 is coupled to transistor MP2's gate, gate signal bus component g3 is coupled to the gate terminal of transistor MP3, gate signal bus component g4 is coupled to the gate terminal of transistor MP4, gate signal bus component g5 is coupled to the gate terminal of transistor MP5, gate signal bus component g6 is coupled to the gate terminal of transistor MP6, gate signal bus component g7 is coupled to the gate terminal of transistor MP7 and gate signal bus component g8 is coupled to the gate terminal of transistor MP8. The sizes of the transistors MP0 to MP8 are dimensioned such that the respective channel length is always the same, and the channel width increases with a factor of $2^x$ of a reference width w, starting at half of the reference width w, with x ranging from 0 to 7. It follows that the width of transistor MP0 equals 0.5w, the width of transistor MP1 equals w, the width of transistor MP2 equals 2w, the width of transistor MP3 equals 4w, the width of transistor MP4 equals 8w, the width of transistor MP5 equals 16w, the width of transistor MP6 equals 32w and the widths of transistors MP7 and MP8 equal 64w. Transistors MP0 to MP8 are implemented as p-channel MOS transistors, for example. The coupling of the drain terminals of the transistors MP0 to MP8 to the defining potential Vd also forms the output of the controlled current source which provides an output current Iout.

The coupling unit CU receives the internal control bus signal d0 to d8, as well as the high control signal Hc. The coupling unit CU also receives the low and the high reference potentials Vgl and Vgh, and outputs the gate signal bus g0 to g8. The coupling unit CU also comprises a high switch s0, two low switches s7 and s8, six low-high switches s1, s2, s3, s4, s5 and s6, a first switch sa and a second switch sb, one inverted high switch xs0, two inverted low switches xs7 and xsS8 and six inverted low-high switches xs1, xs2, xs3, xs4, xs5, and xs6, and an inverter N1. All the switches mentioned are logic controlled switches which means that a logic high at the control input of the switch turns the switch on. Switches s0 to s8 are controlled by the related bit with the same number of the internal control bus signal d0 to d8, respectively. Inverted switches sx0 to sx8 are controlled by the inverted related bit with the same number xd0 to xd8 of the internal control bus signal d0 to d8, respectively.

When the high control signal Hc is low which is the case for codes 0 to 127 according to Table 1, the first switch sa is closed via the inverter N1. The second switch sb is open. It follows that the gate terminals of transistors MP1 to MP6 are coupled either to the low reference potential Vgl via the low-high switches s1 to s6, respectively, or they are coupled to the source potential Vs via the inverted low-high switches xsl to xs6 depending on the value of the bits d1 to d6 of the internal control bus signal d0 to d8, respectively. As soon as one of the gate terminals of transistors MP1 to MP6 is coupled to the low reference potential Vgl, the respective transistor is turned on and contributes with its respective multiple of the step current Ilsb to the output current Iout. For example, transistor MP3 contributes with 4 times the step current Ilsb to the output current Iout when turned on. As for the span of codes from 0 to 127 according to Table 1, the bit d0 of the internal control bus signal d0 to d8 always is 0, the high reference potential Vgh is coupled to the source potential Vs via switch xs0. This means that transistor MP0 stays off. Therefore, the regulation of the output current Iout is achieved by regulating only the low reference potential Vgl.

For the span of codes from 127 to 255 according to Table 1, the high control signal Hc is at logic high or logic 1. It follows that the second switch sb is closed and the first switch sa is opened via the inverter N1. Therefore, the gate terminals of transistors MP0 to MP6 are either coupled to the high reference potential Vgh or they are coupled to the source potential Vs depending on the value of bits d1 to d6 of the internal control bus signal d0 to d8, respectively. For this span of codes, bits d7 and d8 of the internal control bus signal d0 to d8 are at the value 1 according to Table 1. It follows that the gate terminals of transistors MP7 and MP8 are coupled to the low reference potential Vgl. To summarize, for the codes 128 to 255, the low reference potential Vgl and the high reference potential both are directing the gates of the transistors MP0 to MP8. The step current Ilsb is defined as the current which is provided when bits D1 to D7 of the control input bus signal D0 to D7 are at logic low and bit D0 of the control input bus signal D0 to D7 is at logic high resulting in transistor MP1 being switched on.

Consequently, for the first span of codes from 0 to 127, only the low reference potential Vgl is needed to provide the output current Iout. This results in reduced power consumption. For the second span of codes from 128 to 255 both, the low reference potential Vgl and the high reference potential Vgh, are contributing to provide the output current Iout. The transition from code 127 to 128 is smooth and without offset error because for code 127 the low reference potential Vgl controls the coupling unit CU. For the code 128 the low and the high reference potentials Vgl and Vgh are both regulating the output current Iout but the high reference potential Vgh controls only the transistor MP0 which contributes the step current Ilsb to the output current Iout.

As the size of transistor MP7 corresponds to the size of transistor MP8 and equals 64 W, a layout reduction is achieved.

The current generation unit CG described above can be extended to realize a $2^n$ step controlled current source by adding supplementary transistors MP9 to MPn (not shown) to the current sourcing array CS and by using bits D8 to D(n−1) of the control input bus signal and bits d9 to dn of the internal control bus signal as described under FIG. 1. Then sizes of the transistors are chosen as described above for transistors MP0 to MP7. Size of transistor MP8 then equals 128w, size of transistor MP9 equals 256w, and size of transistor MP(n−1) corresponds to the size of transistor MPn. Gate terminals of transistors MP(n−1) and MPn can be coupled to the low reference potential Vgl depending upon the corresponding bits d(n−1), dn of the internal control bus signal are at logic zero or one. A gate terminal of transistor MP0 can be coupled to the high reference potential Vgh depending upon the corresponding bit d0 of the internal control bus signal is 0 or 1. Gate terminals of transistors MP1 to MP(n−1) can either be coupled to the low reference potential Vgl or to the high reference potential Vgh depending upon the high control signal Hc being at logic zero or logic 1 and the corresponding bits d1 to d(n−2) are at logic zero or logic 1.

In an extended embodiment which realizes a $2^n+2^{n-1}$ step controlled current source as described under FIG. 1, the gate terminals of transistors MPn and MP(n−1) are coupled to the low reference potential Vgl if the first additional internal component E1 is at logic zero. If the first additional internal component E1 is at logic 1, the gate terminals of transistors MPn and MP(n−1) are coupled to the high reference potential Vgh.

To implement the second extension described under FIG. 1, the coupling of the gate terminal of transistor MP0 is directed by the second additional internal component E2. If the second additional internal component E2 is at logic zero, the gate of transistor MP0 is coupled to the high reference potential Vgh. If the second additional internal component E2 is at logic one, the gate of transistor MP0 is coupled to the low reference potential Vgl. By this, the resolution of the controlled current source is half of the step current Ilsb. A range of 0 to $(2^n-1)$ times half of the step current Ilsb is achieved.

Figure 2C:
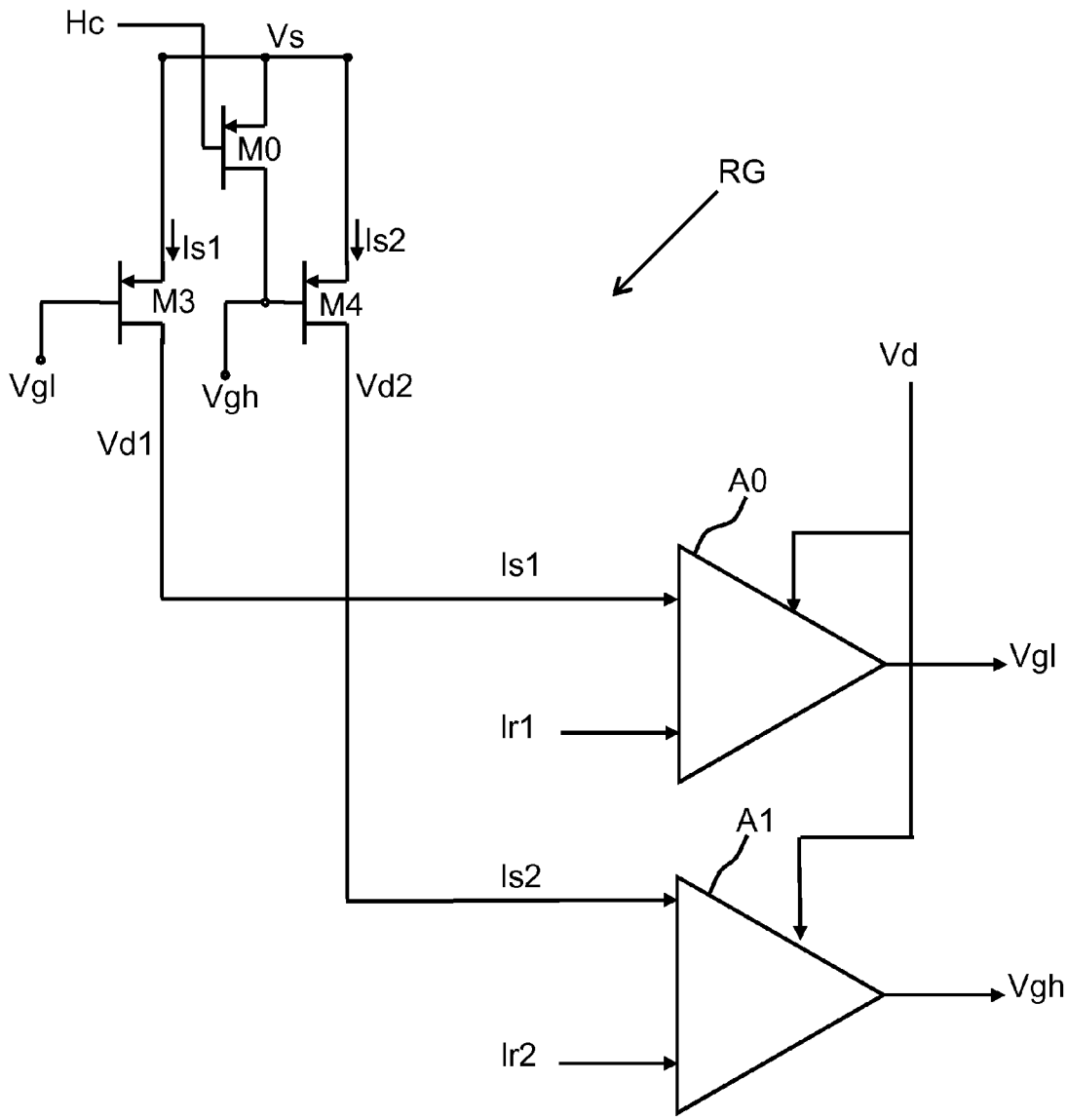
FIG. 2C shows a first exemplary embodiment of a reference generator of the second exemplary embodiment of a controlled current source.

FIG. 2C shows a first exemplary embodiment of a reference generator of the second exemplary embodiment of a controlled current source. This embodiment of the reference generator RG comprises a first differential amplifier A0, a second differential amplifier A1, a first equalizer M3, a second equalizer M4 and a control transistor M0. The first and the second equalizer M3 and M4 and the control transistor M0 each comprise a p-channel MOS transistor. Source terminals of the first and the second equalizer M3 and M4 as well as a source terminal of the control transistor M0 are each coupled to the source potential Vs. A drain terminal of the first equalizer M3 is coupled to a first input of the first differential amplifier A0. A drain terminal of the second equalizer M4 is coupled to a first input of the second differential amplifier A1. A gate terminal of the first equalizer M3 is coupled to the low reference potential Vgl. A gate terminal of the control transistor M0 is connected to the high control signal Hc. A drain terminal of the control transistor M0 is coupled to a gate terminal of the second equalizer M4 which is coupled to the high reference potential Vgh. A first feedback current Is1 is a drain source current of the first equalizer M3. A second feedback current Is2 is a drain source current of the second equalizer M4. A potential at the drain terminal of the first equalizer M3 is defined as a first threshold potential Vd1. A potential at the drain terminal of the second equalizer M4 is defined as a second threshold potential Vd2. A first reference current Ir1 is supplied to the second input of the first differential amplifier A0. A second reference current Ir2 is supplied to the second input of the second differential amplifier A1. The defining potential Vd is supplied to each supply input of the first and the second differential amplifier A0 and A1.

The first and the second equalizers M3 and M4, as well as the control transistor M0 can be implemented as p-channel MOS transistors, for example.

The lengths of the first and the second equalizers M3 and M4 correspond to the lengths of transistors MP0 to MP 8. The widths of the first and the second equalizers M3 and M4 are selected as follows:

$$\frac{Is1}{Ilsb} = \frac{w(M3)}{w} \text{ and } \frac{Is2}{Ilsb} = \frac{w(M4)}{w}$$

Wherein Is1 represents the value of the first feedback current Is1, Is2 represents the value of the second feedback current Is2, Ilsb represents the value of the step current Ilsb, w(M3) represents the value of the width of the first equaliser M3, w(M4) represents the value of the with of the first equaliser M4, and w represents the value of the reference width w. The values for the step current Ilsb, the first and second feedback currents Is1 and Is2 are known from the design respectively.

The first differential amplifier A0 provides the low reference potential Vgl at its output. The low reference potential Vgl is proportional to the difference between the first feedback current Is1 and the first reference current Ir1. The first differential amplifier A0 maintains the first threshold potential Vd1 at the defining potential Vd. The second differential amplifier A1 provides the high reference potential Vgh at its output. The high reference potential Vgh is proportional to the difference between the second feedback current Is2 and the second reference current Ir1. The second differential amplifier A1 maintains the second threshold potential Vd2 equal to the defining potential Vd. The control transistor M0 ensures that as long as the high control signal Hc is low, the high reference potential Vgh equals the source potential Vs and is not regulated by the second differential amplifier A1. By this, the reduction in power consumption is achieved.

Figure 2D:
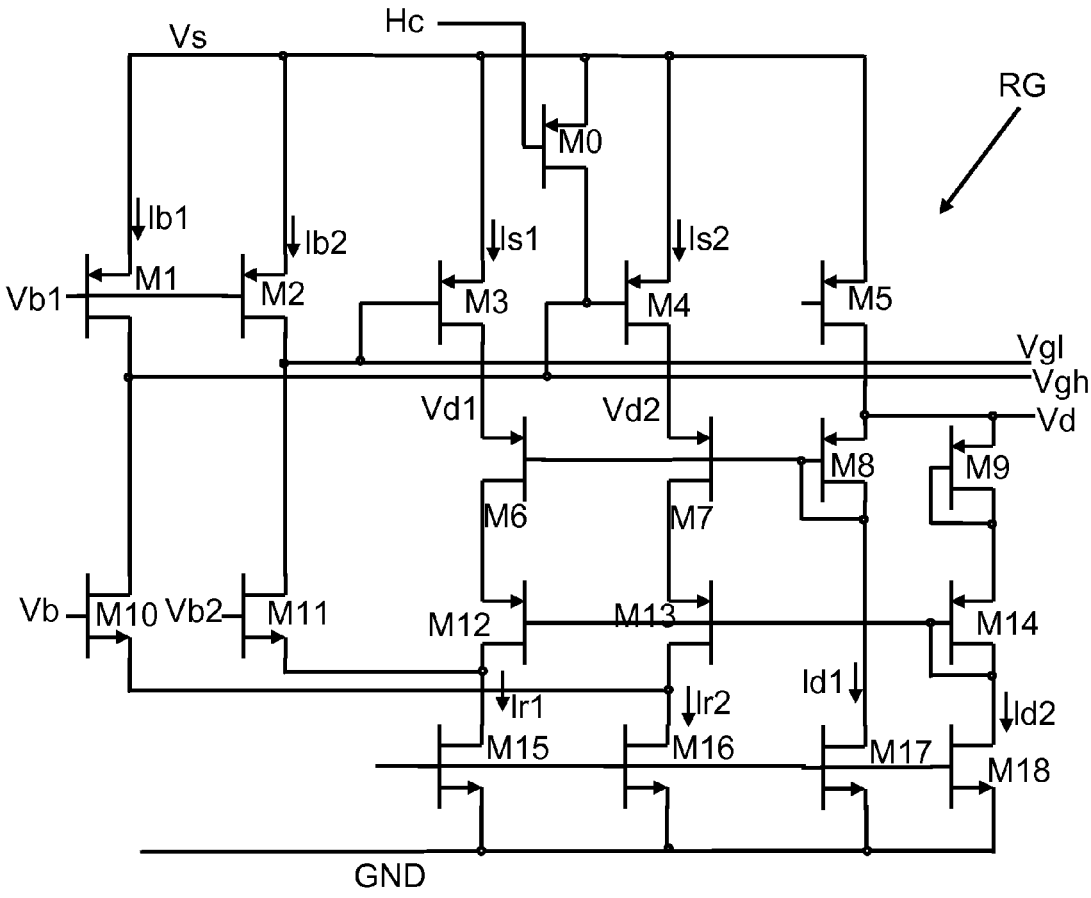
FIG. 2D shows a second exemplary embodiment of a reference generator of the second exemplary embodiment of a controlled current source.

FIG. 2D shows a second exemplary embodiment of a reference generator of the second exemplary embodiment of a controlled current source. This embodiment represents a detailed implementation of the embodiment of the reference generator RG described in FIG. 2C. This embodiment of the reference generator RG is operated in the same way as described in FIG. 2C. This embodiment comprises a low regulation loop, a high regulation loop, a generation circuit for the defining potential Vd and the control transistor M0. The low regulation loop comprises transistors M2, M6, M11, M12, M15, and the first equalizer M3. The high regulation loop comprises transistors M1, M7, M10, M13, M16, and the second equalizer M4. The generation circuit for the defining potential Vd comprises transistors M5, M8, M9, M14, M17, and M18. Transistor M15 is configured to operate as a current source for the first reference current Ir1. Transistor M16 is configured to operate as a current source for the second reference current Ir2.

Transistors M1, M2, M5, M6, M7, M8, M9, M12, M13, and M14 are implemented as p-channel MOS transistors, for example. Transistors M10, M11, M15, M16, M17, and M18 are implemented as n-channel MOS transistors, for example.

The first feedback current Is1 flowing through the first equalizer M3 as its steady state current is equal to the difference between the first reference current Ir1 and a second bias current Ib2 flowing through transistor M2. The second feedback current Is2 which is the steady state current of the second equalizer M4 is equal to the difference between the second reference current Ir2 and a first bias current Ib1 flowing through transistor M1. For the first span of codes from 0 to 127 as of Table 1, the high control signal Hc is low. Therefore, a gate terminal of the second equalizer M4 is coupled to the source potential Vs. It follows that the second equalizer M4 and the transistors M7, M13, and M10 are turned off. When the high control signal Hc equals zero, a bias potential Vb at gate terminal of the transistor M10 can be set to zero. Hence the first bias current Ib1 and the second feedback current Is2 are zero. Consequently, the second reference current Ir2 also equals zero. This means that for the first span of codes from 0 to 127 only the transistors of the low regulation loop are being operated. For this span of codes, the defining potential Vd and the first threshold potential Vd1 are maintained equal. For the span of codes from 0 to 127, transistor MP0 is always off, therefore a saturation voltage of the controlled current source remains low. For the second span of codes from 128 to 255, the defining potential Vd, the first threshold potential Vd1 and the second threshold potential Vd2 are maintained equal by regulation.

The sizes of transistors M6, M7, M8, M12, M13, and M14 are selected as follows:

$$\frac{w(M7)/l(M7)}{w(M8)/l(M8)} = \frac{Ir2 - Ib1}{Id1} = \frac{w(M6)/l(M6)}{w(M8)/l(M8)} \text{ and}$$

$$\frac{w(M13)/l(M13)}{w(M14)/l(M14)} = \frac{Ir2 - Ib1}{Id2} = \frac{w(M12)/l(M12)}{w(M14)/l(M14)}$$

Wherein w(M7) represents the value of the with of transistor M7, l(M7) represents the value of the length of transistor M7, w(M8) represents the value of the with of transistor M8, l(M8) represents the value of the length of transistor M8, w(M6) represents the value of the with of transistor M6, l(M6) represents the value of the length of transistor M6, w(M13) represents the value of the with of transistor M13, l(M13) represents the value of the length of transistor M13, w(M14) represents the value of the with of transistor M14, l(M14) represents the value of the length of transistor M14, w(M12) represents the value of the with of transistor M12, l(M12) represents the value of the length of transistor M12, Ir2 represents the value of the second reference current Ir2, Ib1 represents the value of the first bias current Ib1, Id1 represents the value of a first defining current Id1, and Id2 represents the value of a second defining current Id2.

The size of transistor M9 matches the size of transistor M8.

Figure 3:
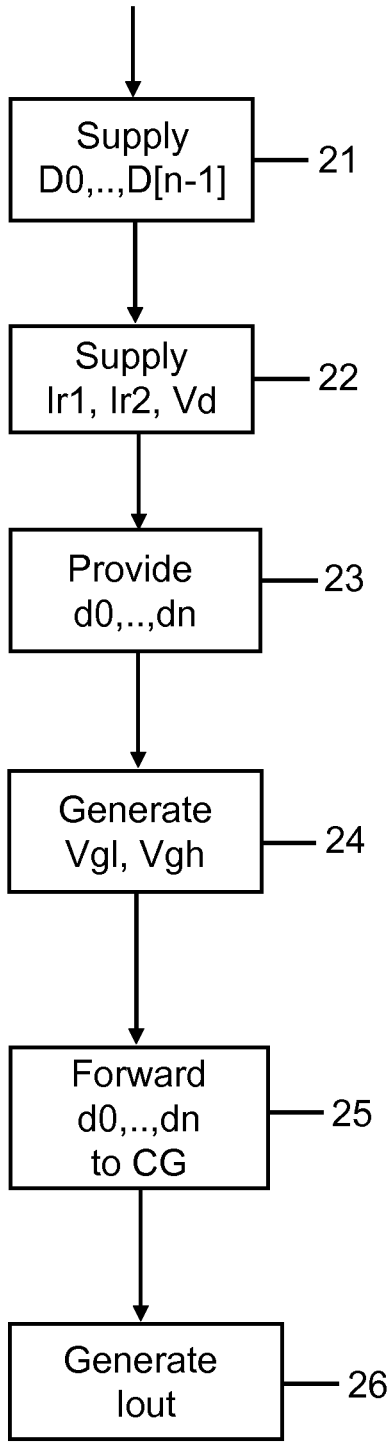
FIG. 3 shows an exemplary embodiment of a flow diagram of a method for sourcing a current.

FIG. 3 shows an exemplary embodiment of a flow diagram of a method for sourcing a current. In a first step 21, the control input bus signal D0 to D(n−1) is supplied. In a second step 22, the first reference current Ir1, the second reference current Ir2, and the defining potential Vd are supplied. In a third step 23, the internal control bus signal d0 to dn is provided as a function of the control input bus signal D0 to D(n−1). The low reference potential Vgl and the high reference potential Vgh are generated in a fourth step 24. The internal control signal d0 to dn is forwarded to the current generating unit CG in the fifth step 25. In a sixth step 26, the output current Iout is generated as a function of the control input bus signal D0 to D(n−1), as well as the low and the high reference potentials Vgl and Vgh.

In other embodiments of a method for sourcing a current, different sequences of steps 21 to 26 can also be realized as long as causal relations between the steps 21 to 26 are adhered to.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A controlled current source comprising:

a signal input to receive a control input bus signal;

a mapping unit with an input coupled to the signal input and an output to provide an internal control bus signal;

a reference generator with an input coupled to the output of the mapping unit and with a low reference output to provide a low reference potential and with a high reference output to provide a high reference potential;

a current generating unit with a first input coupled to the output of the mapping unit, a second input coupled to the output of the reference generator and an output to provide an output current controlled by the control input bus signal and the low and high reference potentials, wherein the control input bus signal comprises a binary coded digital signal with n bits (D0, . . . , D[n−1]), and wherein a first subset of output current levels ranging from zero to $2^{n-1}-1$ is provided using the low reference potential and a second subset of output current levels ranging from $2^{n-1}$ to $2^n$ is provided using the low and high reference potentials.

2. The controlled current source according to claim 1, wherein the internal control bus signal comprises a binary coded digital signal with (n+1) bits.

3. The controlled current source according to claim 1, wherein the reference generator comprises a second input to receive a first reference current, a third input to receive a second reference current, and a fourth input to receive a defining potential.

4. The controlled current source according to claim 1, wherein the current generating unit comprises:

a coupling unit with the first input to receive the internal control bus signal and the second input to receive the low and high reference potentials and with an output to provide a gate signal bus, and a current sourcing array with an input coupled to the output of the coupling unit and with the output which provides the output current.

5. The controlled current source according to claim 4, wherein the current sourcing array comprises an array of transistors coupled in parallel, with their gate terminals coupled to the output of the coupling unit, wherein the array of transistors coupled in parallel is further defined as an array of p-channel MOS transistors MP(n) where n is a positive, non-zero integer, wherein sizes of the transistors of the array of p-channel MOS transistors MP(n) are defined as a quotient of channel width and length, wherein one or more transistors of the array of p-channel MOS transistors MP(n) are defined such that channel widths are characterized as a product of 0.5 and $2^x$, with x ranging from 0 to (n−1), and wherein a size of a last p-channel MOS transistor MP(n) matches a respective size of a second-to-last p-channel MOS transistor MP (n−1).

6. The controlled current source according to claim 3, wherein the reference generator comprises:

a first and a second equalizer, said first equalizer to provide a first threshold potential corresponding to the defining potential, said second-equalizer to provide a second threshold potential corresponding to the defining potential, and a first and a second differential amplifier, said first amplifier to provide the low reference potential using the first reference current and a first feedback current at the first threshold potential, said second amplifier to provide the high reference potential using the second reference current and a second feedback current at the second threshold potential.

7. The controlled current source according to claim 1, wherein the control input bus signal comprises an additional control component and the internal control bus signal comprises an additional internal component.

8. The controlled current source according to claim 7, wherein the internal control bus signal comprises a second additional internal component.

9. A method for sourcing a current, comprising:

supplying a control input bus signal;

supplying a first and a second reference current and a defining potential;

providing an internal control bus signal as a function of the control input bus signal;

forwarding the internal control signal to a current generating unit; and generating an output current for a first subset of current levels as a function of the control input bus signal, and a low reference potential, for a second subset of current levels as a function of the control input bus signal, and the low and a high reference potential, wherein the control input bus signal comprises a binary coded digital signal with n bits (D0, . . . , D[n−1]), and wherein a first subset of output current levels ranging from zero to $2^{n-1}-1$ is provided using the low reference potential and a second subset of output current levels ranging from $2^{n-1}$ to $2^n$ is provided using the low and the high reference potentials.

* * * * *